United States Patent [19]

Sasaki

[11] Patent Number: 4,497,513

[45] Date of Patent: Feb. 5, 1985

[54] LOCKING DEVICE FOR DOOR OF COOKING APPARATUS

[75] Inventor: Takafumi Sasaki, Hokkaido, Japan

[73] Assignee: Tokyo Shibaura Denki Kabushiki Kaisha, Kawasaki, Japan

[21] Appl. No.: 418,543

[22] Filed: Sep. 15, 1982

[30] Foreign Application Priority Data

Sep. 21, 1981 [JP] Japan ..... 56-148995

[51] Int. Cl.[3] ..... E05C 3/16

[52] U.S. Cl. ..... 292/217; 292/DIG. 69; 292/340; 292/78

[58] Field of Search ..... 292/78, 79, 217, DIG. 69, 292/191, 192, 216, 201, 340; 70/432, 438

[56] References Cited

U.S. PATENT DOCUMENTS

| | | | |
|---|---|---|---|
| 582,449 | 5/1897 | Zesiger | 292/78 |
| 965,125 | 7/1910 | Terrell | 292/78 |
| 1,236,255 | 8/1917 | Bond | 292/78 |

FOREIGN PATENT DOCUMENTS

| | | |
|---|---|---|
| 5211053 | 4/1982 | Japan . |
| 5325367 | 4/1982 | Japan . |

*Primary Examiner*—Richard E. Moore

*Attorney, Agent, or Firm*—Cushman, Darby & Cushman

[57] ABSTRACT

A door locking device for a microwave oven of the present invention has an engaging member arranged inwardly of the cooking chamber of the housing. An arm is arranged at the rear surface side of a door and is biased clockwise by a spring, such that its horizontal state is kept by a stopper and the arm may be pivoted counterclockwise. A locking eccentric cam having a notched engaging portion is mounted at the distal end of the arm so as to be pivotal about a shaft. As the door is opened/closed, the notched engaging portion of the locking eccentric cam is engaged with the engaging member at the side of the housing to eccentrically pivot the locking eccentric cam, thereby locking/unlocking the door.

4 Claims, 10 Drawing Figures

LOCKING DEVICE FOR DOOR OF COOKING APPARATUS

BACKGROUND OF THE INVENTION

The present invention relates to a locking device for opening and closing the door of a cooking apparatus.

A conventional door locking device is generally provided with a lock mechanism with a hook. The door locking device is mounted inside a door, and the hook is operated by a door handle mounted on the door so as to releasably engage with an engaging hole formed in a cooking (heating) chamber. FIG. 1 shows a door locking device for a microwave oven. Referring to FIG. 1, a movable door handle b is arranged at the front surface of a door a at the free end thereof. A movable hook c is mounted on the rear surface of the door a. The hook c and the door handle b are coupled together by an interlocking mechanism d such as a link incorporated inside the door a. An engaging hole g formed in a locking member f for engaging with the hook c is formed at the front wall of a housing e. Thus, the door handle b may be operated to releasably engage the hook c with the engaging hole g, thereby locking the door a to the housing e and closing a safety switch i. Food in the heating chamber may then be cooked by dielectric heating of microwave energy.

However, in a door locking device adopting the interlocking mechanism d whereby the door handle b is interlocked with the hook c, the structure becomes complex and the number of parts involved increases. Therefore, the overall device becomes costly. Furthermore, since the interlocking mechanism d is arranged inside the door a, extra space is required, imposing a limit on the degree of freedom in designing of the door a. Opening of the door a requires a two-step operation including unlocking and opening the door, and this is liable to result in poor operability. Especially, a microwave oven is provided with an electromagnetically sealed door a adopting the high frequency choke system, for example, so that the composition of the interlocking mechanism d adversely affects the choke system, and degrades the electromagnetic sealing performance.

SUMMARY OF THE INVENTION

The present invention has been made in consideration of this and its object is to provide a locking device for a door of a cooking apparatus, which is simple in construction and which is easy to operate.

In order to achieve the above object, there is provided according to the present invention a locking device for a door of a cooking apparatus, comprising: an arm mounted at the inside of the door of the cooking apparatus; an eccentric cam rockably mounted on the end portion of the arm, the eccentric cam having a notched portion for locking the door; means for rocking the eccentric cam within the limit of a predetermined angle about a rocking axis; engaging means provided in a housing of the cooking apparatus, the engaging means being engaged with the notched portion; and means for switching an energizing circuit of the cooking apparatus, the switching means being operated by the notched portion.

DETAILED DESCRIPTION OF THE PREFERRED EMBODIMENTS

Figure 1:
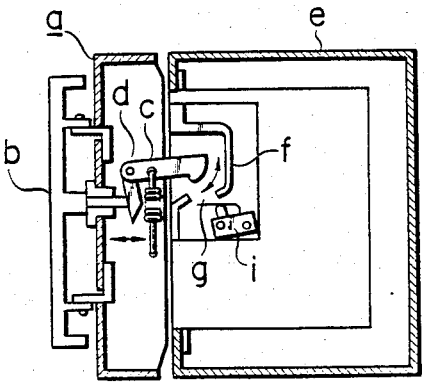
FIG. 1 is a vertical sectional view showing a conventional door locking device.
Figure 2:
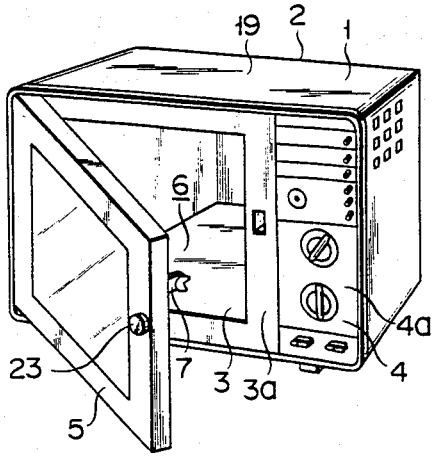
FIG. 2 is a perspective view showing a microwave oven to which the present invention is applied.

The first embodiment of the present invention will now be described with reference to the accompanying drawings. Referring to FIG. 2, a cooking (heating) chamber 3 is arranged inside a housing 1 of a microwave oven 2. Heating equipment such as a high-frequency oscillator (not shown) and a heater (not shown) is arranged inside the housing 1. Food (not shown) is cooked in the heating chamber 3. A control panel 4 having various operation sections 4*a* such as a plurality of cooking selection controls, a cooking timer, and a cooking start switch is arranged at the right-hand side of the front surface of the housing 1. Desired cooking may be performed by operating the operation sections 4*a*. A transversely opening door 5 is pivotally supported at the left-hand side of the front surface of the housing 1 to be at the left side of the operation panel 4. The door 5 opens/closes the opening of the heating chamber 3. A door locking device 6 is arranged at the free end of the rear surface of the door 5 and at the corresponding front wall 3*a* of the heating chamber 3.

Figure 3A:
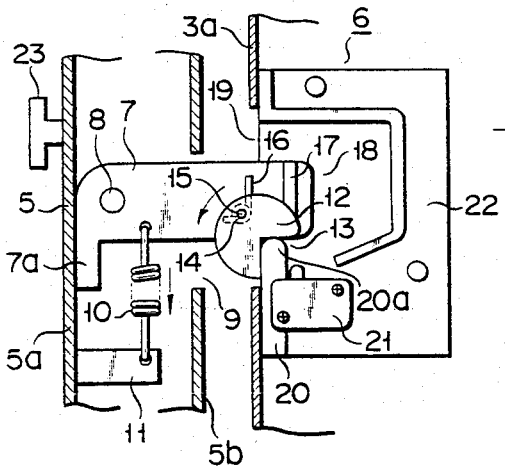
FIGS. 3A to 3C are side views showing the structure of a door locking device according to a first embodiment of the present invention and the manner in which the door is locked to the main body.
Figure 3B:
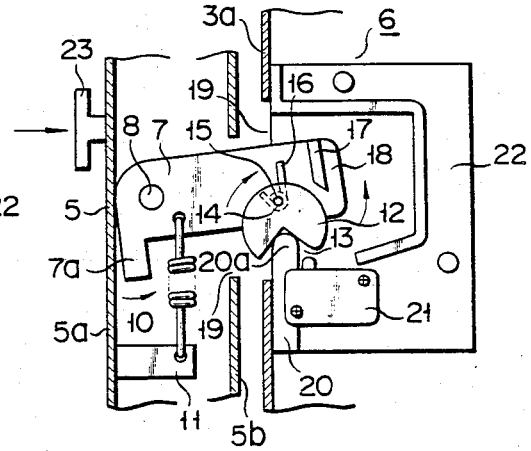
Figure 3C:
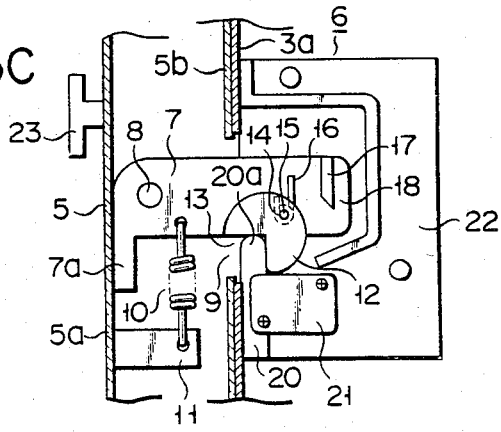

FIGS. 3A to 3C show the details of the structure of the door locking device 6. Referring to these figures, reference numeral 7 denotes a plate-shaped arm of substantially L-shaped cross section which has a stopper portion 7*a*. The proximal end portion of the arm 7 is pivotally supported on a shaft 8 which is mounted on an outer wall 5*a* of the door 5. The distal end of the arm 7 extends toward the housing 1 through an insertion hole 9 of an inner wall 5*b* of the door 5. The arm 7 thus has a length such that it may be inserted inside the housing 1 when the door 5 is closed. The arm 7 is biased clockwise by a spring 10 whose one end is mounted to a support member 11 and is held horizontal by the stopper portion 7*a*. Only when an external force is applied on the arm 7, the arm 7 is pivoted counterclockwise against the biasing force of the spring 10. A disc-shaped locking eccentric cam 12 is pivotally mounted on the distal end portion of the arm 7. A sector-shaped notched engaging portion 13 of about 90° is formed around the circumference of the locking eccentric cam 12. A pivotal fulcrum hole 14 is formed on a line which bisects the notched engaging portion 13, so that the cam 12 eccentrically rotates about a shaft 15 mounted on the arm 7, which extends through the pivotal fulcrum hole 14. A restoring mechanism 18 consists of a torsion spring 16 wound around the shaft 15 and while the ends of spring 16 are fixed on the arm 7 and the cam 12, respectively, a stopper 17 projecting on the side surface of the arm 7. Accordingly, because of the counterclockwise torque of the torsion spring 16 the locking eccentric cam 12 is normally set to the state shown in FIG. 3A wherein the notched engaging portion 13 faces to the side.

An insertion hole 19 for allowing insertion of the locking eccentric cam 12 is formed in the front wall 3*a* of the heating chamber 3 to correspond to the locking eccentric cam 12 arranged at the side of the door 5. A pin 20 as the engaging member is arranged inwardly of the insertion hole 19 and is locked to a mount seat 22. An arcuate portion 20*a* is formed at the distal end of the pin 20 and opposes the notched engaging portion 13 of the locking eccentric cam 12 in the initial state as shown in FIG. 3A. A safety switch 21 connected to a power supply circuit of the high-frequency oscillator lies inwardly of the pin 20. The safety switch 21 is closed upon pivotal movement of the locking eccentric cam 12. Reference numeral 23 is a handle opening/closing the door arranged on the front wall of the door 5.

Figures 4A, 4B, 4C:
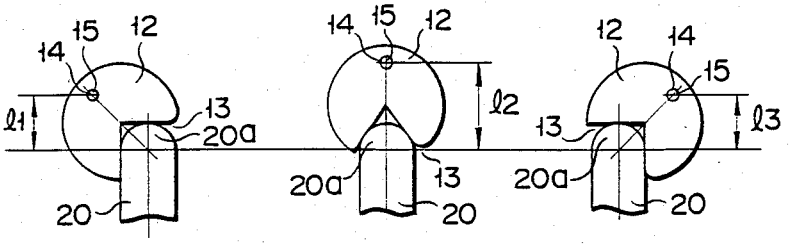
FIGS. 4A to 4C are views showing changes in the state of engagement between the locking eccentric cam and the engaging member for opening/closing the door.

In order to close the door 5 of the microwave oven 2, the handle 23 is operated to pivot the door 5 to the closed position. Then, the arm 7 and the locking eccentric cam 12 are moved into the housing 1 through the insertion hole 19, and one surface of the notched engaging portion 13 contacts the side surface of the pin 20, as shown in FIG. 3A. Subsequently, the locking eccentric cam 12 eccentrically pivots while being engaged with the outer surface of the arcuated portion 20*a* of the pin 20 to establish a state shown in FIG. 3B. In this state, the pivotal fulcrum hole 14 of the locking eccentric cam 12 moves from the position at the left-hand side of the pin 20 as shown in FIG. 4A to the position above the pin 20 as shown in FIG. 4B. The distance between the centers of the pivotal fulcrum hole 14 and the pin 20 changes from l1 to l2 (where $l1<l2$), and the arm 7 pivots to the maximum point. The arm 7 then pivots against the biasing force of the spring 10 to accumulate a restoring force to restore the original state. When the door 5 is pivoted to the closed position, the locking eccentric cam 12 rapidly pivots by the restoring force accumulated in the arm 7. Then, as shown in FIGS. 3C and 4C, and pivotal fulcrum hole 14 is located to the right of the pin 20, so that the distance between the centers of the pivotal fulcrum hole 14 and the pin 20 changes from l2 to l3 (where $l1=l3<l2$) to establish the final engagement state between the pin 20 and the locking eccentric cam 12. In this manner, the door 5 is locked with the inner wall 5*b* of the door 5 in tight contact with the front wall 3*a* of the heating chamber 3. Simultaneously, the locking eccentric cam 12 is pivoted to close the safety switch 21, thereby allowing to provide the high frequency oscillator with driving power through the power supply circuit.

In order to open the door 5, the handle 23 is operated to pivot the door 5 to the open position. Then, the arm 7 and the locking eccentric cam 12 operate in the reverse manner to that described above. Engagement between the pin 20 and the locking eccentric cam 12 is rapidly released to establish the state shown in FIG. 3A and the door 5 is opened. The locking eccentric cam 12 is restored to the initial state by the restoring mechanism 18.

Since the door 5 may be locked or unlocked by a single operation (pulling or pushing), opening/closing operation of the door 5 is easily performed. Locking or unlocking of the door 5 also effects the on-off operation of the safety switch 21. Furthermore, since the restoring force of the arm 7 acts immediately before closing and opening the door 5 to facilitate opening/closing of the door 5, the door 5 is easy to open, and the closed door 5 is in tight contact with the front wall 3*a* of the heating chamber 3. Therefore, sealing is guaranteed to prevent microwave energy and heated air in the heating chamber from leaking. A conventional complex interlocking mechanism is not incorporated inside the door 5, no locking and unlocking may be accomplished with a lock mechanism comprising a small number of parts such as the arm 7 and the cam 12. Therefore, the number of parts used is decreased, assembly is facilitated and the manufacturing cost is decreased. The above-mentioned locking device does not adversely affect the electromagnetic sealing structure of the high frequency choke system, and an excellent electromagnetic sealing may be provided. Since the conventional interlocking mechanism as described above is not incorporated inside the door 5, there may be less limitation with respect to the design of the door 5.

Figure 5:
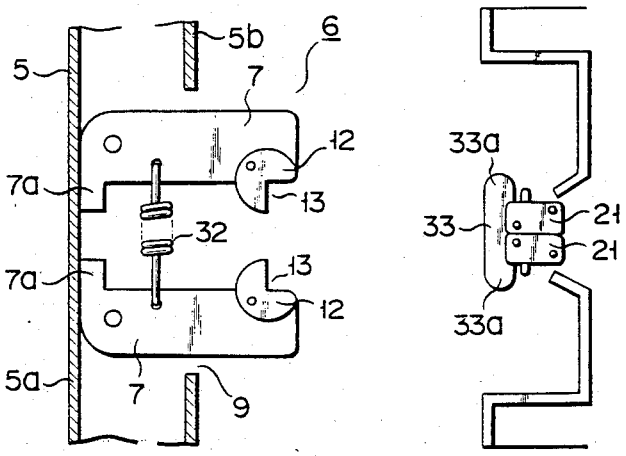
FIG. 5 is a side view of the main part of a door locking device according to a second embodiment of the present invention.
Figure 6:
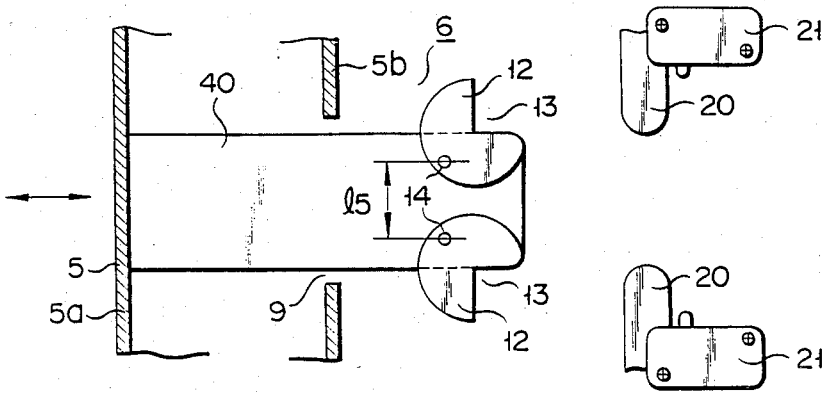
FIG. 6 is a side view of the main part of a door locking device according to a third embodiment of the present invention.

The second embodiment of the present invention will now be described with reference to FIG. 5. A door locking device 6 of this embodiment has vertically opposing arms 7 each having a locking eccentric cam 12 at the distal end portion thereof and having a similar structure as that of the first embodiment described above. The arms 7 are coupled by a spring 32. A pin 33 having arcuated portions 33*a* as engaging members on both sides thereof is arranged inside the heating chamber. Safety switches 21 are arranged inwardly of the pin 33. The door 5 may be locked or unlocked in the second embodiment in a similar manner as in the first embodiment.

The third embodiment of the present invention will now be described. A door locking device 6 of this embodiment has a structure to be described below. An arm 40 is made of an elastic material such as plastics. Locking eccentric cams 12 of the same construction as that of the first embodiment face back to back at the upper and lower sides of the distal end portion of the arm 40. Pins 20 as engaging members and safety switches 21 are arranged at the side of the housing in correspondence with notched engaging portions 13 of the cams 12. The arm 40 is subjected to elastic deformation such that a distance l5 between centers of pivotal fulcrum holes 14 may be smaller than that in the initial state when the locking eccentric cams 12 engage with pins 20 to pivot to the state shown in FIG. 4B to open/close the door 5. By the restoring force of the arms 40, the locking eccentric cams 12 are rapidly pivoted from the state shown in FIG. 4B to the state shown in FIG. 4C or FIG. 4A. In this third embodiment, the door 5 may be locked and unlocked by a similar operation as in the first embodiment.

Although the above embodiments are applied to doors of transversely opening type, they may also be applied to doors of vertically opening type.

Furthermore, in the above embodiment, the present invention is applied to a microwave oven. However, the present invention may also be applied to cookers which have a heating function by means of an electric heater, a gas heater, or the like.

The door locking device of the present invention allows easy operation since a single pulling or pushing operation can effect locking of the door. Since the number of parts required is decreased, and assembly is easy, the manufacturing cost is decreased. Also, design restrictions are eliminated simplifying the design procedure.

What is claimed is:

1. A locking device for a door of a cooking apparatus, comprising:

a cooking apparatus housing including a door;

an arm including an end portion, said arm being pivotably mounted at an inside portion of the door and including means for pivoting said arm within a limit of a predetermined rotation angle about a pivoting axis;

an eccentric cam rockably mounted on the end portion of said arm, said eccentric cam having a notched portion for the locking the door;

means for rocking said eccentric cam within the limit of a predetermined angle about a rocking axis;

engaging means provided in the cooking apparatus housing, said engaging means being engaged with said notched portion; and means for switching an energizing circuit of said cooking apparatus, said switching means being operated by said notched portion.

2. A device according to claim 1, wherein a pair of said arms with said eccentric cams and a pair of said engaging means at the side of said housing are provided to oppose to each other.

3. A device according to claim 1, wherein said arm comprises a plate-shaped body having elasticity, a pair of said eccentric cams are arranged at both sides of a distal end portion of said arm, and a pair of said engaging means at the side of said having correspond to said eccentric cams.

4. A device according to claim 1, 2 or 3, wherein said eccentric cam is of disc-shape, a sector-shaped notched engaging portion of about 90° is formed around a circumference of said eccentric cam, and a pivotal fulcrum is on a line bisecting said sector-shaped notched engaging portion.

* * * * *